US006522341B1

(12) United States Patent
Nagata

(10) Patent No.: US 6,522,341 B1
(45) Date of Patent: Feb. 18, 2003

(54) MULTI-LAYER IMAGE MIXING APPARATUS

(75) Inventor: Atsushi Nagata, Osaka (JP)

(73) Assignee: Matsushita Electric Industrial Co., Ltd., Osaka (JP)

( * ) Notice: Subject to any disclaimer, the term of this patent is extended or adjusted under 35 U.S.C. 154(b) by 267 days.

(21) Appl. No.: 09/580,970

(22) Filed: May 30, 2000

(30) Foreign Application Priority Data

Jun. 2, 1999 (JP) ..... 11-154544

(51) Int. Cl.[7] ..... G09G 5/00
(52) U.S. Cl. ..... 345/639; 637/634
(58) Field of Search ..... 345/629, 634, 345/637, 639

(56) References Cited

U.S. PATENT DOCUMENTS 4,951,229 A 8/1990 Dinicola et al.
5,621,869 A * 4/1997 Drews ..... 345/639
6,118,427 A * 9/2000 Buxton et al. ..... 345/637

FOREIGN PATENT DOCUMENTS

JP 2-140846 5/1990
JP 7-319669 12/1995
JP 9-179965 7/1997
JP 10-164351 6/1998

* cited by examiner

*Primary Examiner*—Matthew Luu

(57) ABSTRACT

After having stored one line of a rearmost layer in an image memory, a mixer repeatedly performs an image mixing process until the mixer has processed one line of a foremost layer. The mixing process includes the steps of: mixing one line previously stored in the image memory with another line that has just been input by calculating a weighted average of these two lines; and storing the newly mixed line in the image memory. As a result of this repetitive process performed by the mixer, a combined line, which has been stored finally in the image memory, is output to a display monitor. The mixer will continuously operate until the mixer has processed the last line of the foremost layer. Semitransparent mixing of multiple layers is implementable using a small-sized image memory for image mixing. In addition, where the image memory is made up of first and second line memories each having a storage capacity of one line, display operation and mixing process can be executed concurrently.

6 Claims, 3 Drawing Sheets

MULTI-LAYER IMAGE MIXING APPARATUS

BACKGROUND OF THE INVENTION

The present invention relates to a multi-layer image mixing apparatus for creating a composite image from multiple image layers.

An image mixing technique is disclosed in U.S. Pat. No. 4,951,229. According to this technique, a process of selecting one of a plurality of pixels, which have been obtained from multiple bit planes in parallel, is repeatedly performed, thereby creating a single combined image. These pixels are selected with reference to the display priorities assigned to respective bit planes.

This prior art is advantageous in that a composite image can be created using no buffer memories. However, since just one pixel is selected from a number of pixels, the technique is not applicable to semitransparent mixing of multiple layers.

SUMMARY OF THE INVENTION

It is therefore an object of the present invention to implement semitransparent mixing of multiple layers by using a small-sized image memory for image mixing.

To achieve this object, according to the present invention, multiple layers are processed sequentially using the small-sized image memory repeatedly. The semitransparent mixing is implementable by weighting a pixel value associated with one or more processed layers and stored in the image memory and a pixel value associated with a next layer and adding these weighted values together.

Specifically, the present invention provides a multi-layer image mixing apparatus for creating a composite image from multiple image layers. The apparatus includes: an image memory; and input means for sequentially inputting image fractions of the multiple image layers from foremost through rearmost ones. Each of the image fractions is located at the same position in associated one of the layers and has a size of one frame or less. The apparatus further includes: initializing means for initializing the image memory by storing the image fraction of the rearmost layer in the image memory; and mixing means for performing the process steps of a) mixing one of the image fractions that was stored previously in the image memory with another one of the image fractions that has just been input by calculating a weighted average of these two image fractions and b) storing the newly mixed image fraction in the image memory. The mixing means repeatedly performs the process steps a) and b) until the mixing means has processed the image fraction of the foremost layer. The apparatus further includes: output means for outputting a combined image fraction that has been finally stored in the image memory by the mixing means; and control means for making the input, initializing, mixing and output means perform their processes continuously until the last image fraction of the foremost layer has been processed.

The image memory for use in image mixing may have a storage capacity equivalent to one line of a raster-scan display device, for example. In such a case, the image fraction has a size of one line, and a frame, which is made up of the combined lines that have been sequentially output from the image memory, is presented on the display device. It should be noted that the storage capacity of the image memory can be determined irrespective of the number of layers to be combined.

DETAILED DESCRIPTION OF THE INVENTION

Figure 1:
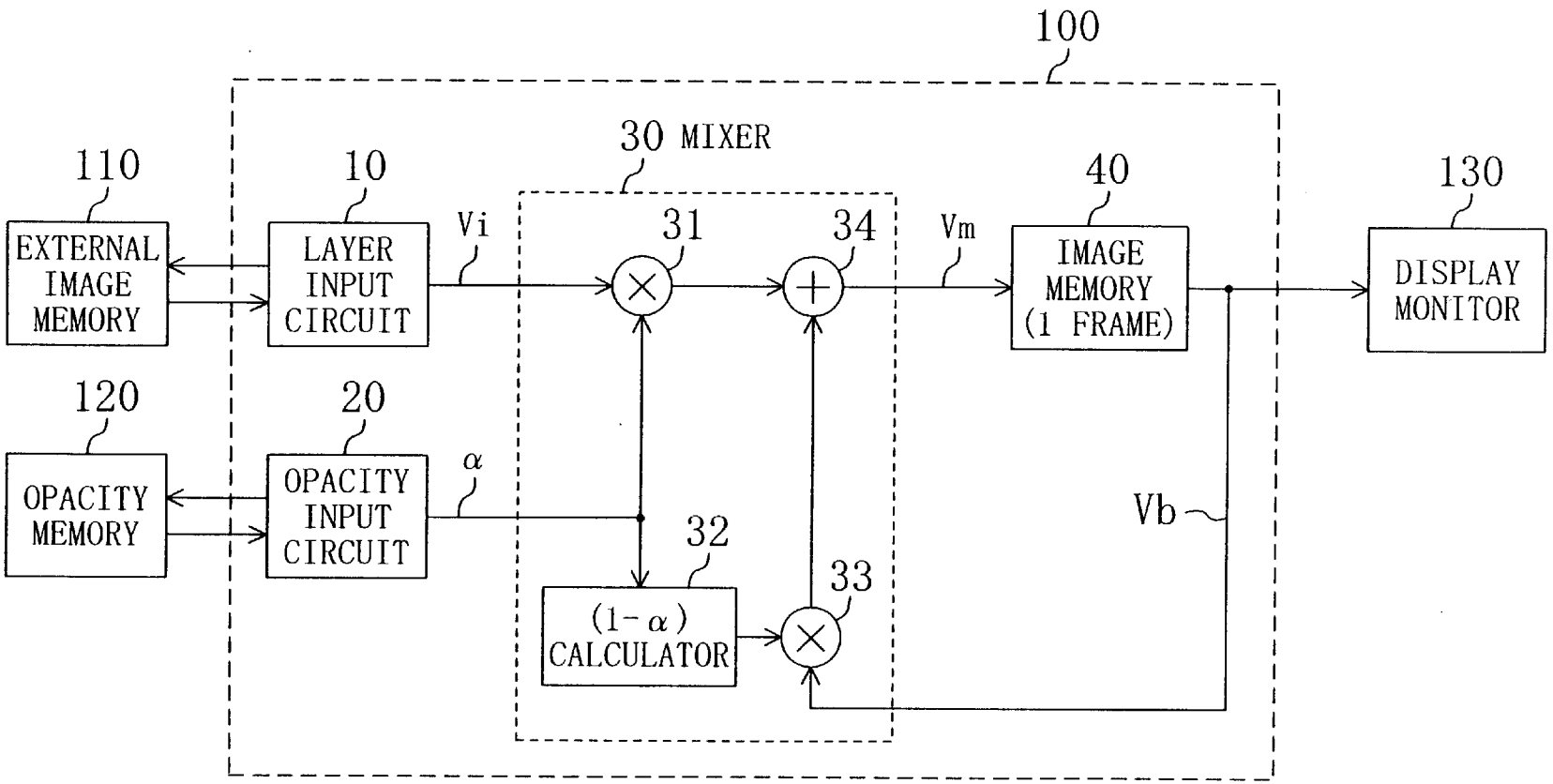
FIG. 1 is a block diagram illustrating an exemplary configuration for a display system using an inventive multi-layer image mixing apparatus.

FIG. 1 illustrates an exemplary configuration for a display system using an inventive multi-layer image mixing apparatus. The display system shown in FIG. 1 includes the inventive multi-layer image mixing apparatus 100, external image memory 110, opacity memory 120 and raster-scan display monitor 130. The mixing apparatus 100 creates a composite image from multiple image layers and includes layer input circuit 10, opacity input circuit 20, mixer 30 and image memory 40. Multiple image layers, stored in the external image memory 110, are sequentially input to the layer input circuit 10. The opacity stored in the opacity memory 120 is input to the opacity input circuit 20. The mixer 30 carries out a layer mixing process. And the image memory 40 has a storage capacity of one frame.

The layer input circuit 10 provides an input video signal Vi, which represents a frame of each of the rearmost to foremost layers, to the mixer 30. Synchronously with the input video signal Vi, the opacity input circuit 20 provides an opacity $\alpha$, which is represented as a value between zero and one, to the mixer 30.

After having initialized the image memory 40 by storing the frame of the rearmost layer in the memory 40, the mixer 30 repeatedly performs an image mixing process until the mixer 30 has processed the frame of the foremost layer. The mixing process includes the steps of: mixing one frame previously stored in the image memory 40 with another frame that has just been input by calculating a weighted average of these two frames; and storing the newly mixed frame in the image memory 40. The mixer 30 includes first and second multipliers 31 and 33, $(1-\alpha)$ calculator 32 and adder 34. The first multiplier 31 multiplies together a pixel value in the frame represented by the input video signal Vi and the opacity $\alpha$. The second multiplier 33 multiplies together an associated pixel value in the frame represented by a background video signal Vb provided from the image memory 40 and $(1-\alpha)$. And the adder 34 adds together the products obtained by the first and second multipliers 31 and 33. The sum obtained by the adder 34 is stored as a stored video signal Vm in the image memory 40. Suppose n (which is an integer equal to or greater than 2) is the number of image layers to be combined, k is an integer between 1 and n, Vik is an input video signal associated with the $k^{th}$ layer, $\alpha k$ is the opacity of the $k^{th}$ layer and Vb(k−1) is a background video signal associated with the processing result up to the $(k-1)^{th}$ layer. In such a case, the stored video signal Vmk associated with the $k^{th}$ layer is given by $$Vmk=Vik\times\alpha k+Vb(k-1)\times(1-\alpha k)$$

The process expressed by this recursion formula will be continued until the frame of the foremost layer has been processed. As a result of such a repetitive process performed by the mixer 30, a composite frame, which has been stored finally in the image memory 40, is output to the display monitor 130 and then presented on the screen of the monitor 130. The repetitive process of the mixer 30 is supposed to be finished within a vertical retrace interval of the display monitor 130.

Figure 2A:
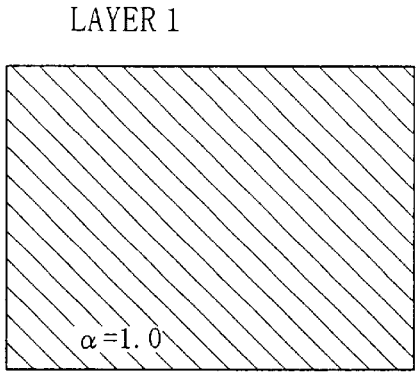
FIGS. 2A through 2E schematically illustrate a process of combining three layers with each other.
Figure 2B:
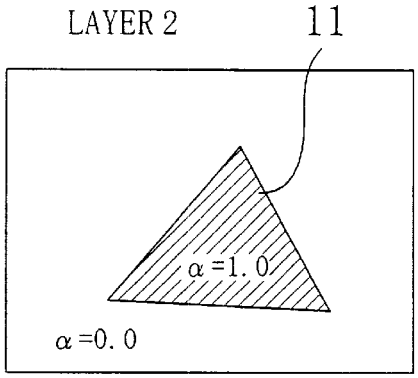
Figure 2C:
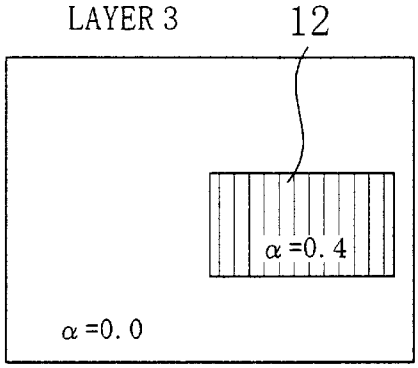
Figure 2D:
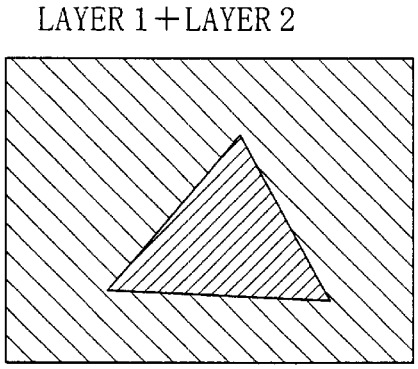
Figure 2E:
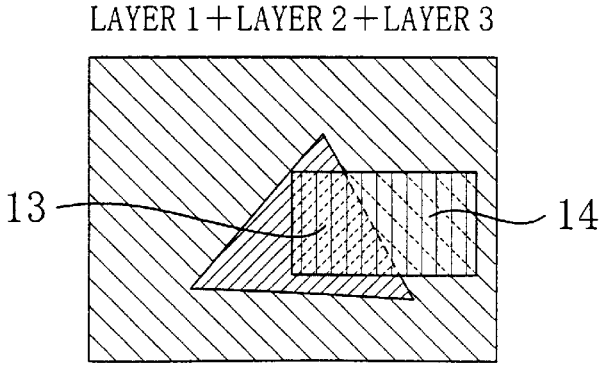

FIGS. 2A through 2E schematically illustrate how the multi-layer image mixing apparatus 100 combines three layers with each other. As shown in FIG. 2A, $\alpha$=1.0 (i.e., totally opaque) in the entire area of the first, rearmost layer 1. In the second layer 2, a totally opaque, triangular area 11 with $\alpha$=1.0 is surrounded by an area with $\alpha$=0.0 (i.e., totally transparent) as shown in FIG. 2B. And in the third, foremost layer 3, a rectangular area 12 with $\alpha$=0.4 (i.e., semitransparent) is surrounded by a totally transparent area with $\alpha$=0.0 as shown in FIG. 2C. FIG. 2D illustrates a result obtained by combining the layers 1 and 2, while FIG. 2E illustrates a result obtained by combining the layers 1, 2 and 3. In FIG. 2E, areas 13 and 14 are semitransparent where $\alpha$=0.4.

Figure 3:
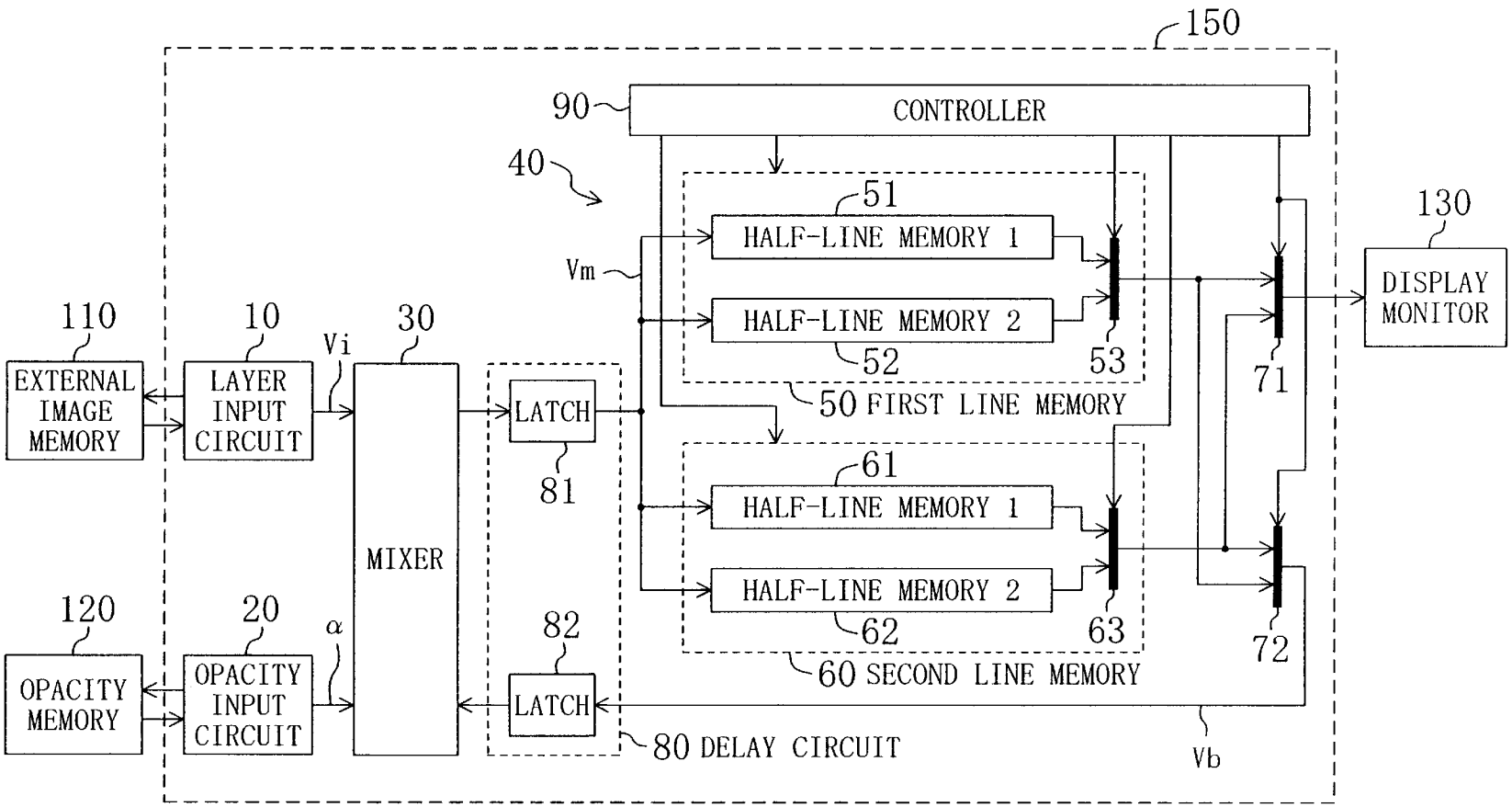
FIG. 3 is a block diagram illustrating an exemplary configuration for another display system using another inventive multi-layer image mixing apparatus.

FIG. 3 illustrates an exemplary configuration for another display system using another inventive multi-layer image mixing apparatus. The display system shown in FIG. 3 includes the inventive multi-layer image mixing apparatus 150, external image memory 110, opacity memory 120 and raster-scan display monitor 130. The mixing apparatus 150 also creates a composite image from multiple image layers. The apparatus 150 includes not only the layer input circuit 10, opacity input circuit 20 and mixer 30 but also image memory 40, display multiplexer 71, feedback multiplexer 72, delay circuit 80 and controller 90. Multiple image layers, stored in the external image memory 110, are sequentially input to the layer input circuit 10. The opacity stored in the opacity memory 120 is input to the opacity input circuit 20. The mixer 30 carries out a layer mixing process. And the image memory 40 consists of first and second line memories 50 and 60 each having a storage capacity of one line.

The layer input circuit 10 sequentially inputs image fractions of the multiple image layers from the foremost through the rearmost ones as the input video signals Vi to the mixer 30. In this case, each image fraction is located at the same position in associated one of the layers and has a size of one line. Synchronously with the input video signal Vi, the opacity input circuit 20 provides the opacity $\alpha$, which is represented as a value between zero and one, to the mixer 30.

After having initialized the image memory 40 by storing one line of the rearmost layer in the memory 40, the mixer 30 repeatedly performs an image mixing process until the mixer 30 has processed the line of the foremost layer. The mixing process includes the steps of: mixing one line previously stored in the image memory 40 with another line that has just been input by calculating a weighted average of these two lines; and storing the newly mixed line in the image memory 40. The mixer 30 also includes the respective components shown in FIG. 1. As a result of the repetitive process performed by the mixer 30, a composite line, which has been stored finally in the image memory 40, is output to the display monitor 130 and then presented on the screen of the monitor 130. The layer input circuit 10, opacity input circuit 20 and mixer 30 will continuously operate until the last line of the foremost layer has been processed. Consequently, a composite frame, which is made up of composite lines that have been sequentially output from the image memory 40, is presented on the display monitor 130.

More specifically, the display and feedback multiplexers 71 and 72 are provided such that while the composite line finally stored in the first line memory 50 is being output to the display monitor 130, the mixer 30 can repeatedly perform the mixing process using the second line memory 60 or that while the composite line finally stored in the second line memory 60 is being output to the display monitor 130, the mixer 30 can repeatedly perform the mixing process using the first line memory 50. Accordingly, the line mixing process of the multiple layers has only to be finished within an interval in which one line is presented on the display monitor 130. Switching of these multiplexers 71 and 72 is controlled by the controller 90.

The first line memory 50 includes first and second half-line memories 51 and 52 each having a storage capacity of half line and a multiplexer 53 for switching the outputs of these memories 51 and 52. Specifically, while two pixels are being read out from the first half-line memory 51 to the mixer 30, another two pixels are written on the second half-line memory 52. And while two pixels are being read out from the second half-line memory 52 to the mixer 30, another two pixels are written on the first half-line memory 51. Accordingly, reading and writing can be performed concurrently on the first line memory 50. The controller 90 switches the modes of operation of these half-line memories 51 and 52 from read into write, or vice versa, and also controls the multiplexer 53.

The second line memory 60 also includes first and second half-line memories 61 and 62 each having a storage capacity of half line and a multiplexer 63 for switching the outputs of these memories 61 and 62. Specifically, while two pixels are being read out from the first half-line memory 61 to the mixer 30, another two pixels are written on the second half-line memory 62. And while two pixels are being read out from the second half-line memory 62 to the mixer 30, another two pixels are written on the first half-line memory 61. Accordingly, reading and writing can also be performed concurrently on the second line memory 60. As in the first line memory 50, the controller 90 switches the modes of operation of these half-line memories 61 and 62 from read into write, or vice versa, and also controls the multiplexer 63.

The delay circuit 80, consisting of latches 81 and 82, is interposed for timing adjustment purposes on a path leading from the feedback multiplexer 72 to the image memory 40 by way of the mixer 30. The number of latches included in the delay circuit 80 is equal to the number of pixels successively readable from the first and second half-line memories 51 and 52 and successively writable on the first and second half-line memories 51 and 52. The number of the latches is also equal to the number of pixels successively readable from the first and second half-line memories 61 and 62 and successively writable on the first and second half-line memories 61 and 62.

The display system shown in FIG. 1 or 3 is so constructed as to independently set the presentation order and opacities for respective layers, and is suitably applicable to presenting maps and cursors on a car navigation system, for example.

In the example illustrated in FIG. 1, if the mixer 30 can finish its repetitive process within one horizontal retrace interval of the display monitor 130, then the storage capacity of the image memory 40 may be reduced to one line equivalent, for example. In such a case, the layer input circuit 10, opacity input circuit 20 and mixer 30 may operate just like the counterparts shown in FIG. 3.

What is claimed is:

1. A multi-layer image mixing apparatus for creating a composite image from multiple image layers, the apparatus comprising:

an image memory;

input means for sequentially inputting image fractions of the multiple image layers from foremost through rearmost ones, each said image fraction being located at the same position in associated one of the layers and having a size of one frame or less;

initializing means for initializing the image memory by storing the image fraction of the rearmost layer in the image memory;

mixing means for performing the process steps of a) mixing one of the image fractions that was stored previously in the image memory with another one of the image fractions that has just been input by calculating a weighted average of these two image fractions and b) storing the newly mixed image fraction in the image memory, the mixing means repeatedly performing these process steps a) and b) until the mixing means has processed the image fraction of the foremost layer;

output means for outputting a combined image fraction that has been finally stored in the image memory by the mixing means; and control means for making the input, initializing, mixing and output means perform their processes continuously until the last image fraction of the foremost layer has been processed.

2. The apparatus of claim 1, wherein each said image fraction has a size of one line, and wherein a frame, which is made up of the combined image fractions that have been sequentially output from the image memory, is presented on a raster-scan display device.

3. The apparatus of claim 1, wherein the mixing means comprises:

means for inputting an opacity, the opacity being represented as a value between zero and one;

first multiplication means for multiplying together a pixel value of each said input image fraction and the opacity;

second multiplication means for multiplying together a value of an associated pixel in the image fraction stored in the image memory and a value obtained by subtracting the opacity from one; and adding means for adding together products obtained by the first and second multiplication means, wherein a sum obtained by the adding means is stored in the image memory.

4. The apparatus of claim 1, wherein the image memory comprises first and second memories each having an equal storage capacity, and wherein while the combined image fraction that has been finally stored in the first memory is being output, the mixing means repeatedly performs the mixing process using the second memory, and while the combined image fraction that has been finally stored in the second memory is being output, the mixing means repeatedly performs the mixing process using the first memory.

5. The apparatus of claim 1, wherein the image memory comprises first and second half-memories each having a storage capacity corresponding to half of the image fraction, and wherein while a pixel is being read out from the first half-memory to the mixing means, another pixel is written on the second half-memory, and while a pixel is being read out from the second half-memory to the mixing means, another pixel is written on the first half-memory.

6. The apparatus of claim 5, further comprising a delay circuit interposed between the mixing means and the image memory, wherein the number of latches included in the delay circuit is equal to the number of pixels that is readable successively from the first and second half-memories and to the number of pixels that is writable successively on the first and second half-memories.

* * * * *